US010096329B2

(12) United States Patent
Ma et al.

(10) Patent No.: US 10,096,329 B2
(45) Date of Patent: Oct. 9, 2018

(54) ENHANCING INTELLIGIBILITY OF SPEECH CONTENT IN AN AUDIO SIGNAL

(71) Applicant: DOLBY LABORATORIES LICENSING CORPORATION, San Francisco, CA (US)

(72) Inventors: Guilin Ma, Beijing (CN); Xiguang Zheng, Beijing (CN); C. Phillip Brown, Castro Valley, CA (US)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 0 days.

(21) Appl. No.: 15/311,821

(22) PCT Filed: May 22, 2015

(86) PCT No.: PCT/US2015/032147

§ 371 (c)(1),
(2) Date: Nov. 16, 2016

(87) PCT Pub. No.: WO2015/183728

PCT Pub. Date: Dec. 3, 2015

(65) Prior Publication Data

US 2017/0098456 A1 Apr. 6, 2017

Related U.S. Application Data

(60) Provisional application No. 62/013,950, filed on Jun. 18, 2014.

(30) Foreign Application Priority Data

May 26, 2014 (CN) ..... 2014 1 0236155

(51) Int. Cl.
*G10L 25/78* (2013.01)
*G10L 21/00* (2013.01)
(Continued)

(52) U.S. Cl.
CPC ..... *G10L 21/0364* (2013.01); *G10L 21/034* (2013.01); *G10L 21/0388* (2013.01); *G10L 25/93* (2013.01)

(58) Field of Classification Search
CPC ..... G10L 21/00; G10L 21/02; H03G 9/00; H03G 9/02
(Continued)

(56) References Cited

U.S. PATENT DOCUMENTS 6,167,138 A 12/2000 Shennib
7,010,133 B2 3/2006 Chalupper
(Continued)

OTHER PUBLICATIONS

Choi et al., "Speech Reinforcement Based on Soft Decision under Far-End Noise Environments", Aug. 2009, IEICE Transactions vol. E92-A No. 8 pp. 2116-2119.*
(Continued)

*Primary Examiner* — Seong Ah A Shin
(74) *Attorney, Agent, or Firm* — Charles L. Hamilton; Fountainhead Law Group, P.C.

(57) ABSTRACT

Embodiments of the present invention relate to signal processing. Methods for enhancing intelligibility of speech content in an audio signal are disclosed. One of the methods comprises obtaining reference loudness of the audio signal. The method further comprises enhancing the intelligibility of the speech content by adjusting partial loudness of the audio signal based on the reference loudness and a degree of the intelligibility. Corresponding systems and computer program products are also disclosed.

25 Claims, 6 Drawing Sheets

(51) Int. Cl.

| | |
|---|---|
| ***G10L 21/02*** | (2013.01) |
| ***H03G 9/00*** | (2006.01) |
| ***H03G 9/02*** | (2006.01) |
| ***G10L 21/0364*** | (2013.01) |
| ***G10L 25/93*** | (2013.01) |
| ***G10L 21/034*** | (2013.01) |
| ***G10L 21/0388*** | (2013.01) |

(58) Field of Classification Search
USPC ..... 704/205, 225; 381/317
See application file for complete search history.

(56) References Cited

U.S. PATENT DOCUMENTS 7,110,951 B1 9/2006 Lemelson
7,302,062 B2 11/2007 Christoph
8,015,002 B2 9/2011 Li
8,081,780 B2 12/2011 Goldstein
8,103,008 B2 1/2012 Johnston
8,271,276 B1 9/2012 Muesch
8,280,730 B2 10/2012 Song
8,315,398 B2 11/2012 Katsianos
8,380,497 B2 * 2/2013 Mohammad ..... G10L 25/48 704/226
8,437,482 B2 5/2013 Seefeldt
8,488,809 B2 7/2013 Seefeldt
8,498,430 B2 7/2013 Hess
8,560,308 B2 10/2013 Endo
8,626,502 B2 1/2014 Nongpiur
8,731,215 B2 * 5/2014 Seefeldt ..... H03G 3/10 381/102
2004/0148166 A1 * 7/2004 Zheng ..... G10L 21/0208 704/233
2004/0190740 A1 * 9/2004 Chalupper ..... H03G 9/005 381/317
2005/0114127 A1 * 5/2005 Rankovic ..... G10L 21/0364 704/233
2006/0271358 A1 * 11/2006 Erell ..... G10L 21/02 704/225
2008/0219457 A1 * 9/2008 Aarts ..... G10L 21/0364 381/57
2008/0312916 A1 12/2008 Konchitsky
2009/0281805 A1 * 11/2009 LeBlanc ..... G10L 21/0208 704/233
2009/0287496 A1 * 11/2009 Thyssen ..... H03G 7/007 704/500
2009/0304215 A1 12/2009 Hansen
2011/0033055 A1 * 2/2011 Low ..... G10L 21/0208 381/56
2011/0054887 A1 3/2011 Muesch
2011/0125489 A1 * 5/2011 Shin ..... H03G 3/32 704/205
2012/0123770 A1 5/2012 Kang
2013/0035934 A1 2/2013 Nongpiur
2013/0065652 A1 3/2013 Nicholson
2013/0297306 A1 11/2013 Hetherington
2015/0081287 A1 * 3/2015 Elfenbein ..... G10L 21/0208 704/226
2018/0012614 A1 * 1/2018 Soleymani ..... G10L 21/0205

OTHER PUBLICATIONS

McAulay et al. "Speech enhancement using a softdecision noise suppression filter," Apr. 1980, IEEE Trans. Acoust., Speech, Signal Processing, vol. ASSP-28, pp. 137-145.*
Sauert, B. et al "Near End Listening Enhancement: Speech Intelligibility Improvement in Noisy Environments" IEEE Acoustics, Speech and Signal Processing, May 14-19, 2006.
Felber, Franklin "An Automatic Volume Control for Preserving Intelligibility" IEEE Sarnoff Symposium, May 3-4, 2011, pp. 1-5.
Moore, Brian C.J. et al "A Model for the Prediction of Thresholds, Loudness, and Partial Loudness" J. Audio Eng. Soc. vol. 45, No. 4, Apr. 1997, pp. 224-240.
Premananda, B.S. et al "Speech Enhancement Algorithm to Reduce the Effect of Background Noise in Mobile Phones" International Journal of Wireless & Mobile Networks, vol. 5, No. 1, Feb. 2013, pp. 177-189.
Ward, Dominic et al "Multitrack Mixing Using a Model of Loudness and Partial Loudness" AES Convention 133, Oct. 25, 2012.
Choi, Jae-Hun, et al "Speech Reinforcement Based on Soft Decision Under Far-End Noise Environments" IEICE Transactions on Fundamentals of Electronics, Communications and Computer Sciences, Engineering Sciences Society, Tokyo, JP, vol. E92A, No. 8, Aug. 1, 2009, pp. 2116-2119.
Shin, J. et al "Perceptual Reinforcement of Speech Signal Based on Partial Specific Loudness" IEEE Signal Processing Letters, vol. 14, No. 11, pp. 887-890, Nov. 2007.
ANSI/ASA S3.5-1997 (R2012), Speech Intelligibility Index, "Methods for Calculation of the Speech Intelligibility Index" 1997.
Mueller, H. Gustav, et al. "An Easy Method for Calculating the Articulation Index" reprinted from the Hearing Journal, vol. 43, No. 9, Sep. 1990, pp. 1-4.

* cited by examiner

ENHANCING INTELLIGIBILITY OF SPEECH CONTENT IN AN AUDIO SIGNAL

CROSS-REFERENCE TO RELATED APPLICATIONS

This application claims priority to Chinese Patent Application No. 201410236155.5, filed May 26, 2014 and U.S. Provisional Patent Application No. 62/013,950, filed Jun. 18, 2014, each of which is hereby incorporated by reference in its entirety.

TECHNOLOGY

Embodiments of the present application generally relate to signal processing, and more specifically, to enhancing intelligibility of speech content in an audio signal.

BACKGROUND

Audio signals may contain both speech and non-speech components. The speech component contains speech content while the non-speech component may contain, for example, audio contents in the surround channels of a multichannel audio signal. Furthermore, when the audio signal is played back to users, an environmental noise signal may be simultaneously present external to the audio signal. In order to improve user's experiences, it would be desirable to enhance the intelligibility of the speech content contained in the speech component in the presence of interfering sound signals, such as the non-speech component in the audio signal and/or the environmental noise signal external to the audio signal.

As used herein, the term "intelligibility of speech content" refers to an indication of the degree of comprehensibility of the speech content. The term "loudness" refers to a perceptual magnitude corresponding to physical strength of the audio signal. The term "partial loudness" refers to the perceived loudness of the audio signal in the presence of interfering sound signals, such as environmental noise signals. The term "environmental noise signal" refers to a noise signal in an ambient environment external to the audio signal. The term "speech component" refers to a component containing speech content in the audio signal, and the term "non-speech component" refers to a component containing non-speech content in the audio signal.

Some conventional approaches to enhance the intelligibility of the speech content work on the basis of loudness domain processing. In such an approach, the intelligibility of the speech content may be enhanced by controlling partial loudness of the speech component in the audio signal. More specifically, the partial loudness of the speech component is maintained at a reference level of loudness, without taking environmental noise into account. However, there is no mechanism for verifying whether the resulting intelligibility of the speech content is desirable or comfortable to individual users.

It is also known to enhance the intelligibility of the speech content based on excitation domain processing. The intelligibility of the speech content is enhanced by adjusting the audio signal based on the ratio between a speech component and interfering sound signals. Such approach is applicable in scenarios where the internal interfering sound signal is present or where the external interfering sound signal is present. However, this approach does not work when both the non-speech component and the environmental noise signal are present.

SUMMARY

In order to address the foregoing and other potential problems, the present invention proposes methods and systems for enhancing intelligibility of speech content in an audio signal.

In one aspect, embodiments of the present invention provide a method for enhancing intelligibility of speech content in an audio signal, the speech content contained in a speech component of the audio signal. The method comprises: obtaining reference loudness of the audio signal; and enhancing the intelligibility of the speech content by adjusting partial loudness of the audio signal based on the reference loudness and a degree of the intelligibility. Embodiments in this regard further comprise a corresponding computer program product.

In another aspect, embodiments of the present invention provide a system for enhancing intelligibility of speech content in an audio signal, the speech content contained in a speech component of the audio signal. The system comprising: a reference obtaining unit configured to obtain reference loudness of the audio signal; and an intelligibility enhancing unit configured to enhance the intelligibility of the speech content by adjusting partial loudness of the audio signal based on the reference loudness and a degree of the intelligibility.

In yet another aspect, embodiments of the present invention provide a method for enhancing intelligibility of speech content in an audio signal, the audio signal containing a speech component and a non-speech component, the speech component containing the speech content. The method comprises: calculating a first metric indicating a ratio of the speech component to the non-speech component; obtaining a second metric indicating a reference ratio of the speech component to the non-speech component and an environmental noise signal; and enhancing the intelligibility of the speech component by adjusting a ratio of the speech component to the non-speech component and the environmental noise signal based on the first and second metrics. Embodiments in this regard further comprise a corresponding computer program product.

In another aspect, embodiments of the present invention provide a system for enhancing intelligibility of speech content in an audio signal, the audio signal containing a speech component and a non-speech component, the speech component containing the speech content. The system comprising: a first metric calculating unit configured to calculate a first metric indicating a ratio of the speech component to the non-speech component; a second metric obtaining unit configured to obtain a second metric indicating a reference ratio of the speech component to the non-speech component and an environmental noise signal; and an intelligibility enhancing unit configured to enhance the intelligibility of the speech component by adjusting a ratio of the speech component to the non-speech component and the environmental noise signal based on the first and second metrics.

Through the following description, it would be appreciated that according to embodiments of one aspect of the present invention, the partial loudness of the audio signal is adjusted based on a degree of the intelligibility of the speech content contained in the speech component of the audio signal such that the intelligibility of the speech content may be enhanced to achieve a certain level of intelligibility. In this way, the intelligibility of the speech content resulted from partial loudness processing may be verified and therefore the high degree of intelligibility may be ensured.

It would also be appreciated that according to embodiments of another aspect of the present invention, the audio signal is adjusted in the excitation domain based on a ratio of the speech component to the non-speech component and a reference ratio of the speech component to the non-speech component and an environmental noise signal when both the non-speech component and the environmental noise signal are present. In this way, there is provided in the excitation domain a solution directed to the scenario where both the non-speech component and the environmental noise signal are present.

Other advantages achieved by embodiments of the present invention will become apparent through the following descriptions.

DESCRIPTION OF DRAWINGS

Through the following detailed description with reference to the accompanying drawings, the above and other objectives, features and advantages of embodiments of the present invention will become more comprehensible. In the drawings, several embodiments of the present invention will be illustrated in an example and non-limiting manner, wherein.

DESCRIPTION OF EXAMPLE EMBODIMENTS

Figure 1:
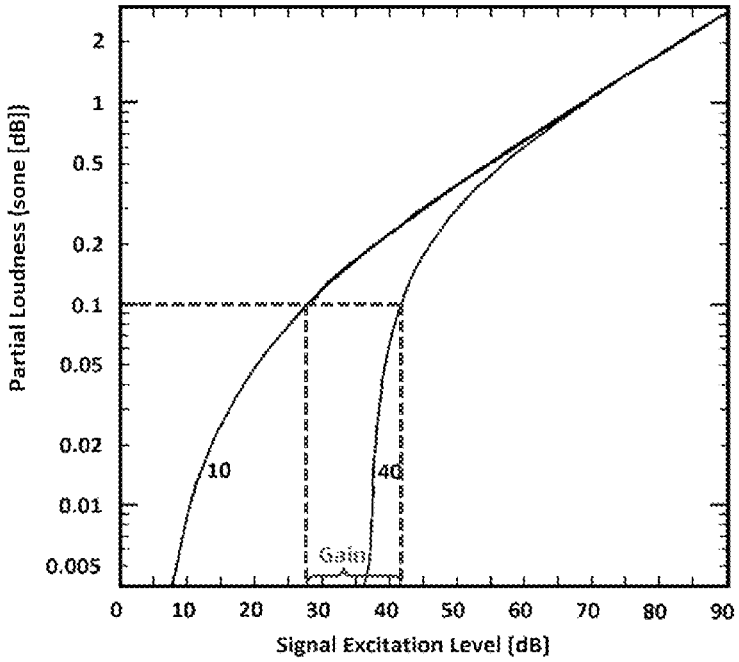
FIG. 1 is an example graph illustrating the influence of the environmental noise signal on gains for the audio signal in the partial loudness domain processing.

Principles of the present invention will now be described with reference to various example embodiments illustrated in the drawings. It should be appreciated that depiction of these embodiments is only to enable those skilled in the art to better understand and further implement the present invention, not intended for limiting the scope of the present invention in any manner.

As described above, an example approach for enhancing the intelligibility of the speech content in the loudness domain is maintaining the partial loudness of the audio signal at a level of reference loudness without the environmental noise signal. Accordingly, an appropriate gain for modifying the audio signal can be derived to ensure the constant partial loudness of the audio signal in the presence of the environmental noise signal. For example, the loudness of the audio signal without the noise signal is first derived, which is served as the target loudness. Then the appropriate gains for the audio signal are derived for adjusting the partial loudness to the target loudness.

Generally, the partial loudness of the audio signal decreases with the increase of the loudness of the other interfering sound signals. Thus, the higher the level of the environmental noise signal is, the more gain may be applied to the audio signal.

FIG. 1 is an example graph illustrating the influence of the environmental noise signal on gains for the audio signal in the partial loudness domain processing, wherein the horizontal axis represents the excitation level for the audio signal. As illustrated in FIG. 1, the left curve represents the partial loudness under the environmental noise signal of 10 dB, while the right curve represents the partial loudness under the environmental noise signal of 40 dB. In order to maintain the same partial loudness (e.g., 0.1 sone in dB as illustrated in the vertical axis), when the level of the noise signal has been increased from 10 dB to 40 dB, there is required an additional gain of more than 20 dB as illustrated in FIG. 1. Thus, by applying the appropriate gains, the partial loudness of the audio signal can be preserved under different levels of noise signals. As described above, there is no mechanism for verifying whether the resulting intelligibility of the speech content is desirable in the conventional approach.

In one aspect of the present invention, in order to address the above and other potential problems, some embodiments of the present invention proposes a method and system for enhancing the intelligibility of the speech content such that the enhanced intelligibility achieves a certain degree of intelligibility, for example, meets a certain intelligibility criterion. After the partial loudness of the speech content is adjusted to reference loudness, e.g., the loudness without the environmental noise signal, it is determined whether the resulting intelligibility achieves a certain degree of intelligibility. If the resulting intelligibility does not achieve the certain degree of intelligibility, the partial loudness of the speech content will be further adjusted based on the determination result. In this way, the intelligibility of the speech content resulted from partial loudness processing may be verified and therefore the high degree of intelligibility may be ensured.

Figure 2:
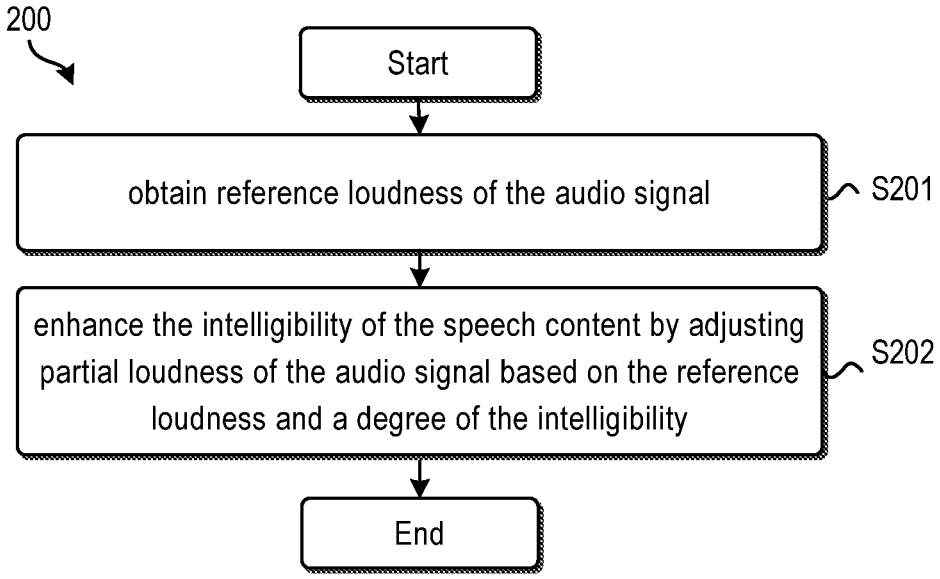
FIG. 2 illustrates a flowchart of a method for enhancing the intelligibility of speech content in an audio signal according to some example embodiments of the present invention.

Now reference is made to FIG. 2 which illustrates a flowchart of a method 200 for enhancing the intelligibility of speech content in an audio signal according to some example embodiments of the present invention.

In the embodiments of the present invention, the audio signal may include at least a speech component which contains the speech content. Optionally, the audio signal may contain a non-speech component. When the speech component is mixed with the non-speech component in the audio signal, the speech and non-speech components may be separated by applying, for example, a technique of blind source separation. Alternatively, the speech and non-speech components may be separated directly when object-based audio format is employed, wherein it is known in advance whether the center channel of a multichannel audio signal contains speech or non-speech object tracks.

In the embodiments of the present invention, the method 200 may be applied to the following three scenarios: 1) a speech component and an environmental noise signal are present; 2) a speech component and a non-speech component are present; 3) a speech component, a non-speech component and an environmental noise signal are present. Now the method 200 will be described in detail with respect to FIG. 2.

As shown in FIG. 2, at step S201, a reference loudness of the audio signal is obtained. Then, at step S202, the partial loudness of the audio signal is adjusted based on the reference loudness and a degree of intelligibility of the speech content such that the intelligibility of the speech content may be enhanced. According to embodiments of the present invention, the degree of the intelligibility of the speech content may be represented by a value, e.g., a score of the intelligibility. Alternatively or additionally, the degree of the intelligibility may be represented by a level from a group consisting of several predefined levels such as high, medium, low, and the like.

With the method 200, the partial loudness of the audio signal is not necessarily always fixed at a level of specific reference loudness. Instead, the partial loudness of the audio signal may be adjusted dynamically based on the degree of the intelligibility of the speech content.

In some embodiments of the present invention, the method 200 may be iteratively performed until the desirable degree of the intelligibility of the speech content is achieved, which will be described below in detail with respect to FIG. 2.

In an embodiment of the present invention, when the method 200 is performed initially, at step S201, the initial reference loudness may be set as the loudness of the audio signal without interfering sound signals. Specifically, in a scenario where a speech component and an environmental noise signal are present, the initial reference loudness may be set as the loudness of the speech component without the environmental noise signal. In another scenario where a speech component and a non-speech component are present, the initial reference loudness may be set as the loudness of the speech component without the non-speech component. In yet another scenario where a speech component, a non-speech component and an environmental noise signal are present, the initial reference loudness may be set as the loudness of the speech component without the non-speech component and the environmental noise signal.

Then, at step S202, the partial loudness of the audio signal is adjusted based on the initial reference loudness and the achieved degree of the intelligibility after the use of the initial reference loudness in adjusting the partial loudness. If the currently achieved degree of the intelligibility of the speech content is undesirable, the reference loudness is increased by an increment, and the method 200 is iterated until the desirable degree of the intelligibility of the speech content is achieved.

Alternatively, in an embodiment of the present invention, the method 200 may be performed only once and the partial loudness of the audio signal is adjusted to an appropriate loudness. The appropriate loudness may be determined according to the initial reference loudness and the desirable degree of the intelligibility.

For the implementation of adjusting the partial loudness of the audio signal, in one embodiment of the present invention, the partial loudness of the speech component may be increased so as to enhance the intelligibility of the speech content. Specifically, at step S202, the partial loudness of the speech component may be increased based on the reference loudness and the degree of the intelligibility of the speech content such that the intelligibility of the speech content may be enhanced.

Alternatively, in another embodiment the present invention, if the audio signal also contains a non-speech component, the partial loudness of the non-speech component may be reduced so as to enhance the intelligibility of the speech content. Specifically, at step S202, the partial loudness of the non-speech component may be reduced based on the reference loudness and the degree of the intelligibility of the speech content such that the intelligibility of the speech content may be enhanced.

Alternatively, in yet another embodiment the present invention, at step S202, the partial loudness of the speech component may be increased and the partial loudness of the non-speech component may be reduced at the same time. It would be appreciated that in the case where the partial loudness of the non-speech component is adjusted, the reference loudness related to the non-speech component may be obtained. With the adjustment of the non-speech component, the level of the speech component may not need to be changed a lot, and thereby the change of timbre of the speech content may be reduced.

Figure 3:
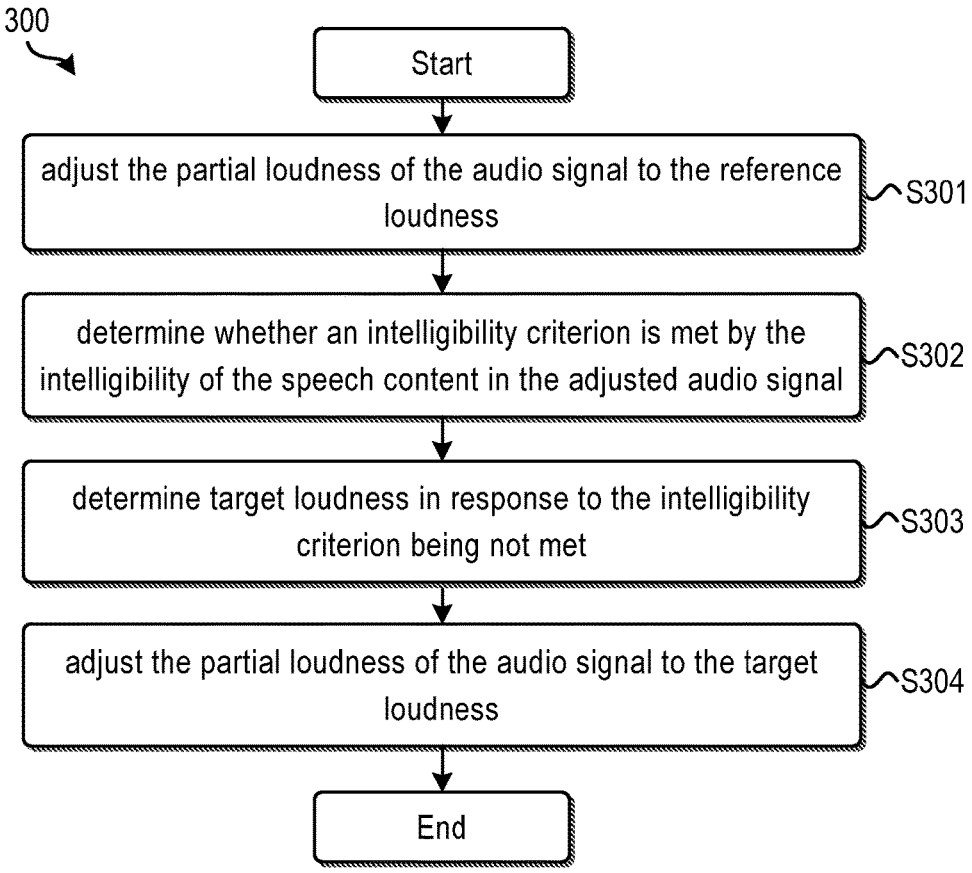
FIG. 3 illustrates a flowchart of a method for enhancing intelligibility of speech content in an audio signal according to some other example embodiments of the present invention.

FIG. 3 illustrates a flowchart of a method 300 for enhancing intelligibility of speech content in an audio signal according to some other example embodiments of the present invention. According to embodiments of the present invention, the method 300 may be implemented after the reference loudness of the audio signal is obtained, for example, in the method 200.

In the method 300, an intelligibility criterion is used for determining the degree of the intelligibility of the speech content such that an evaluation of the degree of the intelligibility may be introduced to ensure the high degree of the intelligibility of the speech content resulted from the partial loudness processing.

As illustrated in FIG. 3, in the method 300, at step S301, the partial loudness of the audio signal is adjusted to the reference loudness after the reference loudness is obtained, for example, at step S201 of the method 200. In this way, the intelligibility of the speech content may achieve a certain degree of the intelligibility.

Next, at step S302, it is determined whether an intelligibility criterion is met by the intelligibility of the speech content in the adjusted audio signal. As such, an evaluation of the achieved degree of the intelligibility of the speech content after the previous partial loudness processing may be introduced.

In an embodiment of the present invention, in order to evaluate the intelligibility of the speech content based on the intelligibility criterion, a score of the intelligibility of the speech content may be calculated, wherein more score indicates the higher degree of the intelligibility of the speech content. It should be noted that any other approach of the evaluation of the intelligibility of the speech content may be employed, and the scope of the invention may not be limited in this regard.

After the step of the determination in the method 300, if the criterion is met, it means that the currently achieved intelligibility of the speech content is desirable. Thus, there is no need for additional loudness for adjusting the partial loudness of the audio signal, and the method 300 ends.

If the criterion is not met, it means the currently achieved intelligibility of the speech content is undesirable. Then, the method proceeds to step S303, where target loudness is determined in response to the intelligibility criterion being not met. Then, at step S304, the partial loudness of the audio signal is adjusted to the target loudness. As such, the intelligibility of the speech content may be further enhanced with the introduction of the evaluation of the degree of the intelligibility.

As described with respect to FIG. 2, the method 300 in FIG. 3 may also be iteratively performed until the desirable degree of the intelligibility of the speech content is achieved; alternatively, the method 300 may be performed only once and the partial loudness of the audio signal may be accordingly adjusted to the appropriate loudness for achieving the desirable degree of intelligibility of the speech content.

Specifically, in an embodiment of the present invention, the target loudness may be determined iteratively. For example, whenever the intelligibility criterion is not met, the target loudness is increased by an increment, e.g., minimum amount of the loudness. Then, the partial loudness of the audio signal may be adjusted based on the new target loudness. Next, it is determined again whether the enhanced intelligibility of the speech content meets the intelligibility criterion. The method is iterated until the intelligibility criterion is met.

In another embodiment of the present invention, the target loudness may be determined once based on the degree of the intelligibility of the speech content, e.g., using a mapping function, for example, between the intelligibility and the loudness. The mapping function may be derived from empirical psychoacoustic studies.

Similar to the embodiments as described with respect to FIG. 2, the method 300 may also be applied to the following three scenarios: 1) a speech component and an environmental noise signal are present; 2) a speech component and a non-speech component are present; 3) a speech component, a non-speech component and an environmental noise signal are present.

Likewise, as described with respect to FIG. 2, the intelligibility of the speech content may be enhanced by at least one of increasing the partial loudness of the speech component and reducing the partial loudness of the non-speech component. For the sake of briefness, the detailed description is omitted.

Figure 4:
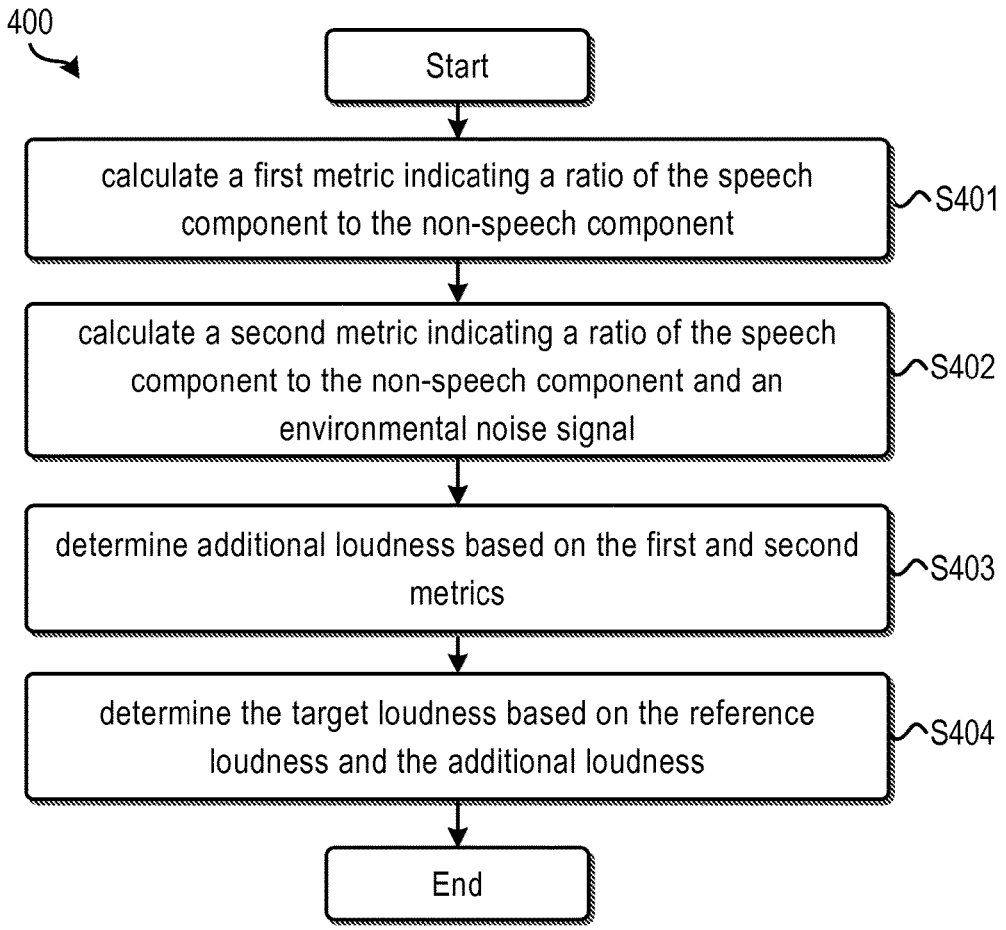
FIG. 4 illustrates a flowchart of a method for determining the target loudness in response to the intelligibility criterion being not met according to some example embodiments of the present invention.

FIG. 4 illustrates a flowchart of a method 400 for determining the target loudness in response to the intelligibility criterion being not met according to some example embodiments of the present invention.

It would be appreciated that the method 400 may be applied to the scenario where a speech component, a non-speech component and an environmental noise signal are present.

According to embodiments of the present invention, before the method 400 is performed, the partial loudness of the audio signal may be adjusted to the reference loudness without the environmental noise signal using the above described methods, and the determination whether the intelligibility criterion is met may also be performed using the above described methods.

In the method 400, the intelligibility of the speech content contained by the speech component may be ensured, while the simultaneously occurring no-speech component may be audible so as to ensure the immersion of the whole audio signal and thereby improve the user's experiences. Now the method 400 will be described in detail with respect to FIG. 4.

According to embodiments of the present invention, in response to the intelligibility criterion being not met by the intelligibility of the speech content, the method 400 starts.

In the method 400, at step S401, a first metric is calculated for indicating a ratio of the speech component to the non-speech component. Then, at step S402, a second metric is calculated for indicating a ratio of the speech component to the non-speech component and an environmental noise signal. Next, at step S403, additional loudness for adjusting the partial loudness of the audio signal is determined based on the first and second metrics. Then, at step S404, the target loudness is determined based on the reference loudness and the additional loudness.

In the embodiments of the present invention, the first and second metrics may be any form of metrics which indicate the ratio of the speech component to the non-speech component and the reference ratio of the speech component to the non-speech component and the environmental noise signal, respectively. For example, the metrics may be the logarithm or any other appropriate functions of the ratios. The scope of the present invention should not be limited in this regard.

It would be appreciated that the difference between the first and second metrics may indicate the interference of the environmental noise signal on the audio signal. With the adjustment of the partial loudness of the audio signal based on the first metric, which indicates a ratio of the speech component to the non-speech component, and the second metric, which indicates a reference ratio of the speech component to the non-speech component and the environmental noise signal, the desirable audio playback quality in the presence of the environmental noise signal may be ensured.

In an embodiment of the present invention, at steps S401 and S402, the first and second metrics may be calculated at least partially based on a frequency band of the audio signal. It is known that the contributions of different frequency bands to the intelligibility of the speech content may be different. With the above process of calculation, the intelligibility of the speech content may be further enhanced.

In an embodiment of the present invention, before the step S402 of the method 400, the partial loudness of the audio signal containing the speech and non-speech components is first adjusted to the reference loudness without the presence of the environmental noise signal using the above described methods. Thus, the loudness of audio signal is enhanced so that the whole audio playback quality may be ensured.

Specifically, in an embodiment of the present invention, the first and second metrics are both calculated and weighted for a frequency band of the audio signal. The calculated first metric is given by the following Equations (1):

$$SAR_{SI} = \sum_{b} W(b) \cdot \max\left(\min\left(20\log_{10}\frac{S_s(b)}{S_{ns}(b)}, T_{max}\right), T_{min}\right) \quad (1)$$

where $SAR_{SI}$ represents the first metric, b represents a frequency band of the audio signal, W(b) represents the weight value for a frequency band, b, $S_s$ (b) represents the speech component of the audio signal for a frequency band, b, $S_{ns}$ (b) represents the non-speech component of the audio signal for a frequency band, b, $T_{max}$ represents the maximum threshold, and $T_{min}$ represents the minimum threshold.

In an embodiment of the present invention, as described above, the second metric may be calculated after the partial loudness of the audio signal containing the speech and non-speech components is adjusted. In this case, the second metric may be calculated and weighted for each frequency band of the audio signal as given in the following Equations (2):

$$SNAR_{SI} = \sum_b W(b) \cdot \max\left(\min\left(20\log_{10}\frac{S_{LR-s}(b)}{S_{LR-ns}(b) + N_{ext}(b)}, T_{max}\right), T_{min}\right) \quad (2)$$

where $SNAR_{SI}$ represents the second metric, b represents a frequency band of the audio signal, W(b) represents the weight value for a frequency band, b, $S_{LR-s}$ (b) represents the partial loudness adjusted speech component of the audio signal for a frequency band, b, $S_{LR-ns}$ (b) represents the partial loudness adjusted non-speech component of the audio signal for a frequency band, b, $N_{est}$ (b) represents the environmental noise signal for a frequency band, b, $T_{max}$ represents the maximum threshold, and $T_{min}$ represents the minimum threshold.

In the embodiments of the present invention, W(b) in Equations (1) and (2) is determined based on the impact of the frequency band to the intelligibility of the speech content. For example, W(b) may be higher, if the frequency band, b, has more impact to the intelligibility of the speech content. The weight may be derived from the speech intelligibility studies and standards, such as the Speech Intelligibility Index (SII, see ANSI S3.5-1997, "Methods for Calculation of the Speech Intelligibility Index") and Articulation Index (AI, see Mueller, G. & Killion, M. (1992)., "An Easy Method for Calculating the Articulation Index", The Hearing Journal, 45(9), 14-17). In the embodiments of the present invention, W(b) may meet the following condition:

$$\Sigma_b W(b)=1 \quad (3)$$

In the embodiments of the present invention, the thresholds $T_{max}$ and $T_{min}$ in Equations (1) and (2) may be used for constraining the first and second metrics within a certain range, e.g., suitable for human's perception such that extremely high or low physical strength of the audio signal is avoided, thereby improving user's experiences. It should be noted that no use of the thresholds may also be feasible, and the scope of the invention should not be limited in this regard.

In an embodiment of the present invention, at step S403, the additional loudness for adjusting the partial loudness of the audio signal is determined based on the difference between the first and second metrics.

Figure 5:
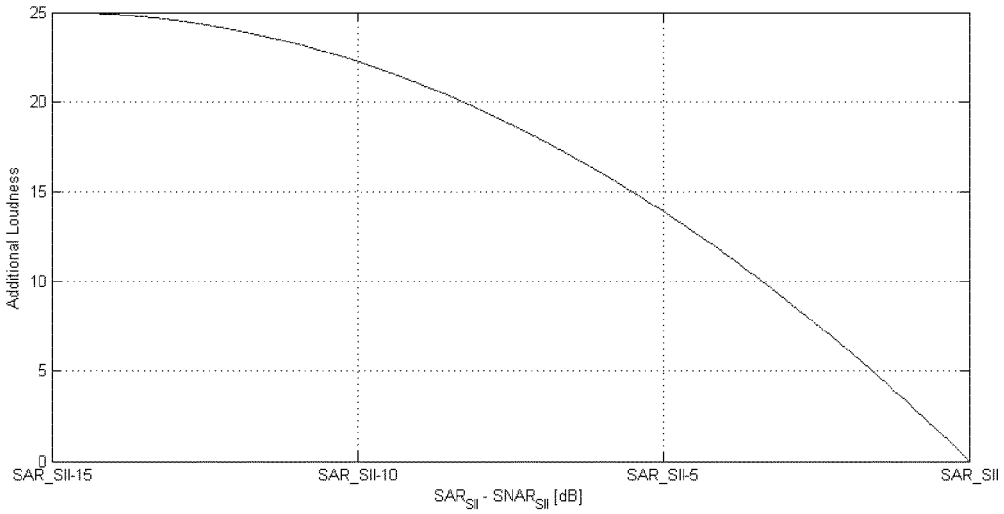
FIG. 5 is a graph illustrating example relationship between loudness and the ratio of the speech component to the non-speech component and ratio of the speech component to the non-speech component and the environmental noise signal according to an example embodiment of the present invention.

Example relationship between the difference of $SAR_{SII}$ and $SNAR_{SII}$ and the additional loudness ($A_L$) is illustrated in FIG. 5. As illustrated in FIG. 5, $A_L$ is increased with the increase of the difference between $SAR_{SII}$ and $SNAR_{SII}$ wherein $SAR_{SII}$ and $SNAR_{SII}$ are determined based on the standard of SII.

Alternatively, in another embodiment of the present invention, the additional loudness may be derived by a defined $SNAR_{SI}$ to additional loudness mapping function, which may be derived from empirical psychoacoustic studies. Alternatively, the mapping function may be derived by recording user behavior to determine the mapping function adaptively.

After the additional loudness, $A_L$, is determined, the target loudness is given by the following Equation (4):

$$F_L=L_0 \cdot 2^{A_L/10} \quad (4)$$

where $L_0$ represents the reference loudness.

It should be noted the calculation of the first and second metrics, and the determination of the additional loudness and the target loudness as discussed above are just for the purpose of illustration, without limiting the scope of the present invention.

As described with respect to FIGS. 2 and 3, the partial loudness of both the speech and non-speech components may be adjusted. In an embodiment of the present invention, after step S404 of the method 400, the appropriate gain to be applied to the speech component may be derived for each frequency band such that the partial loudness of the speech component is adjusted to the target loudness. Alternatively, in another embodiment of the present invention, the appropriate gain to be applied to the non-speech component may be derived for each frequency band such that the non-speech component may be adjusted to the target loudness.

Figure 6:
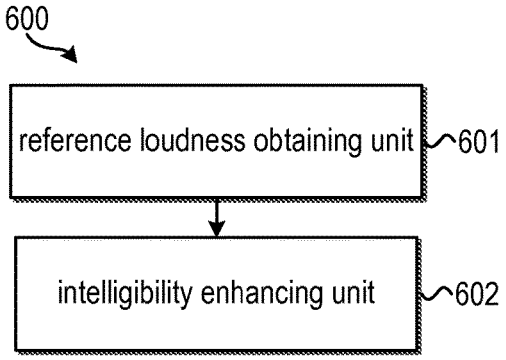
FIG. 6 illustrates a block diagram of a system for enhancing the intelligibility of speech content in an audio signal according to some example embodiments of the present invention.

FIG. 6 illustrates a block diagram of a system 600 for enhancing the intelligibility of speech content in an audio signal according to some example embodiments of the present invention.

As illustrated in FIG. 6, the system 600 may comprise a reference obtaining unit 601 and an intelligibility enhancing unit 602. The reference loudness obtaining unit 601 may be configured to obtain reference loudness of the audio signal. The intelligibility enhancing unit 602 may be configured to enhance the intelligibility of the speech content by adjusting partial loudness of the audio signal based on the reference loudness and a degree of the intelligibility.

In some embodiments of the present invention, the intelligibility enhancing unit 602 may comprise a loudness adjusting unit configured to increase the partial loudness of the speech component based on the reference loudness and the degree of the intelligibility.

Optionally, in some embodiments of the present invention, the intelligibility enhancing unit 602 may comprise a loudness adjusting unit configured to reduce the partial loudness of the non-speech component based on the reference loudness and the degree of the intelligibility in response to a determination that the audio signal contains a non-speech component.

In some embodiments of the present invention, the intelligibility enhancing unit 602 may comprise a loudness adjusting unit configured to adjust the partial loudness of the audio signal to the reference loudness and adjust the partial loudness of the audio signal to a target loudness in response to an intelligibility criterion being not met; an intelligibility determining unit configured to determine whether the intelligibility criterion is met by the intelligibility of the speech content in the adjusted audio signal; a target loudness determining unit configured to determine the target loudness in response to the intelligibility criterion being not met.

In some embodiments of the present invention, the target loudness determining unit may comprise a first metric calculating unit configured to calculate a first metric indicating a ratio of the speech component to the non-speech component; a second metric calculating unit configured to calculate a second metric indicating a ratio of the speech component to the non-speech component and an environmental noise signal; an additional loudness determining unit configured to determine additional loudness based on the first and second metrics; and a determining unit configured to determine the target loudness based on the reference loudness and the additional loudness.

Additionally, in some embodiments of the present invention, the first metric calculating unit may be further configured to calculate the first metric at least partially based on a frequency band of the audio signal. The second metric calculating unit may be further configured to calculate the second metric at least partially based on the frequency band of the audio signal.

For the sake of clarity, some optional components of the system 600 are not illustrated in FIG. 6. However, it should be appreciated that the features as described above with reference to FIGS. 2-4 are all applicable to the system 600. Moreover, the components of the system 600 may be a hardware module or a software unit module. For example, in some embodiments of the present invention, the system 600 may be implemented partially or completely with software and/or firmware, for example, implemented as a computer program product embodied in a computer readable medium. Alternatively or additionally, the system 600 may be implemented partially or completely based on hardware, for example, as an integrated circuit (IC), an application-specific integrated circuit (ASIC), a system on chip (SOC), a field programmable gate array (FPGA), and so forth. The scope of the present invention is not limited in this regard.

With respect to FIGS. 2-6, a method and system for enhancing the intelligibility of the speech content according to some embodiments of one aspect of the present invention have been described above, which may enable the enhanced intelligibility to achieve a certain level of intelligibility by introducing the evaluation of degree of the intelligibility of the speech content in adjusting the partial loudness of the speech component.

As described above, in the excitation domain, an example approach for enhancing the intelligibility of the speech content is aimed at boosting the speech component relative to either the non-speech component or the environmental noise signal. In the excitation domain processing, there is no solution directed to the scenario where both the non-speech component and the environmental noise signal are present.

In another aspect of the present invention, in order to address the above and other potential problems, some embodiments of the present invention proposes a method and system for enhancing the intelligibility of the speech content by adjusting the audio signal in the excitation domain when both the non-speech component and the environmental noise signal are present.

Figure 7:
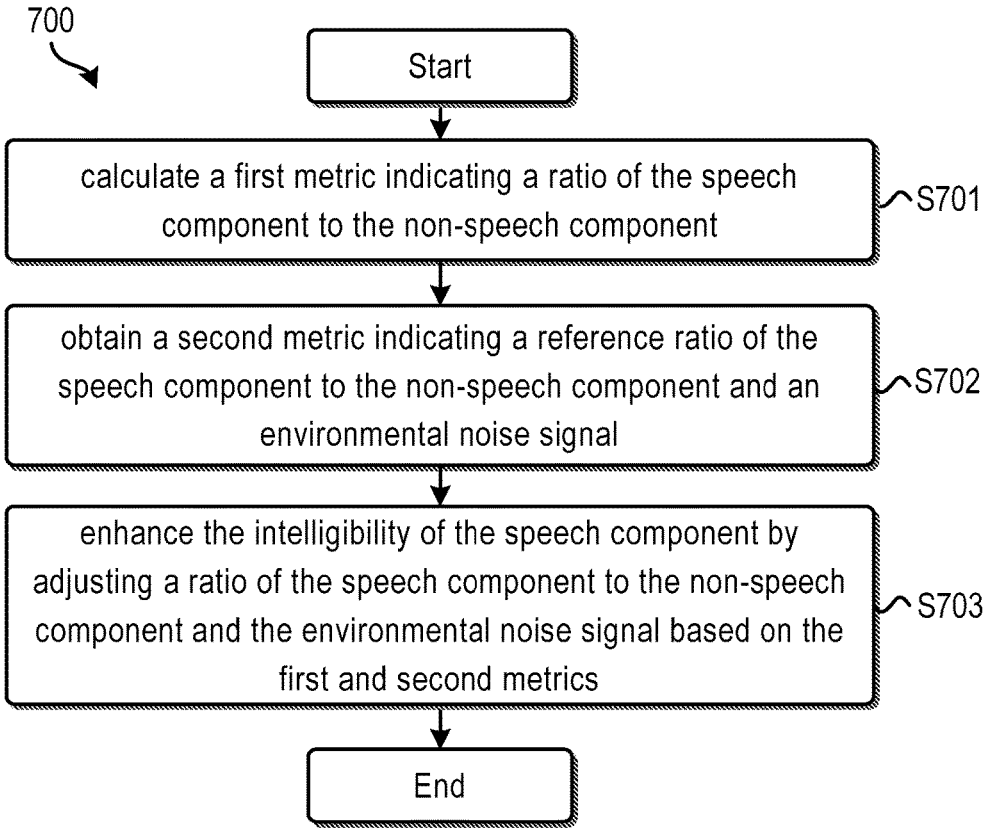
FIG. 7 illustrates a flowchart of a method for enhancing the intelligibility of speech content in an audio signal according to some example embodiments of the present invention.

Now reference is made to FIG. 7 which illustrates a flowchart of a method 700 for enhancing the intelligibility of speech content in an audio signal according to some example embodiments of the present invention.

In the embodiments of the present invention, the audio signal may contain both a speech component and a non-speech component. As described with respect to FIG. 2, the speech and non-speech components may be separated by applying, for example, a technique of blind source separation, or, alternatively, separated directly when object-based audio format is employed. Furthermore, an environmental noise signal may be simultaneously present external to the audio signal.

As illustrated in FIG. 7, in the method 700, at step S701, a first metric is calculated for indicating a ratio of the speech component to the non-speech component. Then, at step S702, a second metric is obtained for indicating a reference ratio of the speech component to the non-speech component and the environmental noise signal. Next, at step S703, the intelligibility of the speech component is enhanced by adjusting a ratio of the speech component to the non-speech component and the environmental noise signal based on the first and second metrics.

With the method 700, the solution for enhancing the intelligibility of the speech content is provided in the excitation domain in the scenario where the environmental noise signal is simultaneously present external the audio signal.

In an embodiment of the present invention, at step S703 of the method 700, the first and second metrics may be compared. If the first metric is less than the second metric, the ratio of the speech component to the non-speech component is adjusted to the first metric, or, otherwise, adjusted to the second metric. As such, less timbre change of the speech signal may be the result from the enhancement of intelligibility of the speech content. It should be noted that the specific approach for adjusting the ratio of the speech component to the non-speech component and the environmental noise signal based on the first and second metrics is not limited to the determination of the lesser one of the first and second metrics as a target of the adjustment discussed above, which is only for the purpose of illustration, but not for the purpose of limitation of the scope of the present invention.

Optionally, in an embodiment of the present invention, before the first metric indicating the ratio of the speech component to the non-speech component is calculated, reference loudness of the audio signal may be obtained. Then, partial loudness of the audio signal may be adjusted to the reference loudness of the audio signal. In an example embodiment of the present invention, the reference loudness may be the loudness of the audio signal without the environmental noise signal. It should be noted that other reference loudness may be employed instead, and the scope of the invention may not be limited in this regard. After such a pre-processing stage, both the speech component and the non-speech component may be enabled to be heard by the users when the environmental noise signal is present, thereby ensuring the immersion of the whole audio signal.

Optionally, in an embodiment of the present invention, at step S703 of the method 700, the ratio of the speech component to the non-speech component and the environmental noise signal is adjusted during a speech section, which contains at least a part of the speech component, and thereby the efficiency of the adjustment may be ensured.

As described above with respect to FIG. 4, the contributions of different frequency bands to the intelligibility of the speech content may be different. The method 700 as illustrated in FIG. 7 may be performed based on each frequency band of the audio signal according to some embodiments of the present invention, which will be described below in detail with respect to FIG. 7.

In an embodiment of the present invention, at step S701 of the method 700, the first metric indicating the ratio of the speech component to the non-speech component may be calculated for a frequency band of the audio signal. specifically, the calculated first metric for a frequency band is given by the following Equation (5):

$$SAR(b) = 20\log_{10}\frac{S_s(b)}{S_{ns}(b)} \tag{5}$$

where b represents a frequency band of the audio signal, SAR(b) represents the first metric for a frequency band, b, $S_s$ (b) represents the speech component of the audio signal for a frequency band, b, and $S_{ns}$ (b) represents the non-speech component of the audio signal for a frequency band, b.

Next, at step S702, the second metric indicating the reference ratio of the speech component to the non-speech component and the environmental noise signal may be obtained at least partially based on the frequency band. For example, the second metric may be derived from the speech intelligibility studies and standards, such as the Speech Intelligibility Index (SIT) and Articulation Index (AI), as described above.

Figure 8:
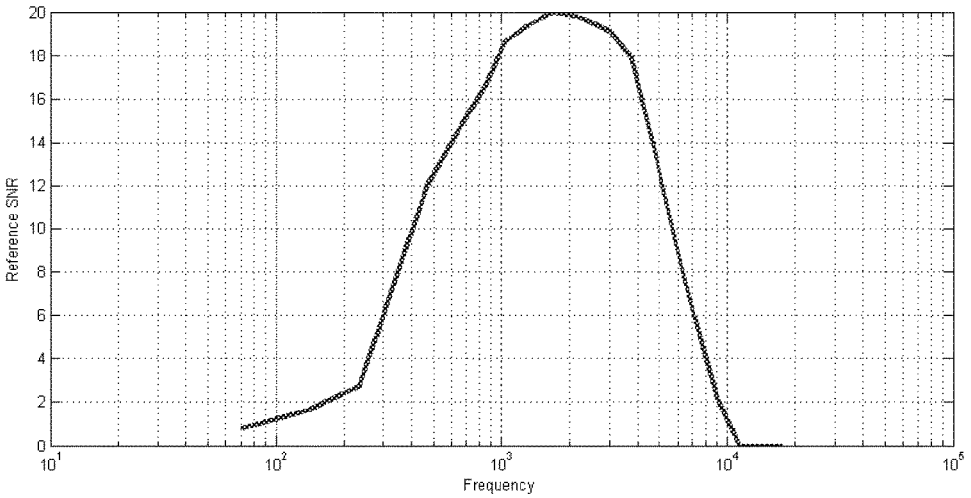
FIG. 8 is a graph illustrating an example of the frequency dependent metric indicating the reference ratio of the speech component to the non-speech component and the environmental noise signal according to an example embodiment of the present invention.

FIG. 8 illustrates an example of the frequency dependent metric indicating the reference ratio of the speech component to the non-speech component and the environmental noise signal according to an example embodiment of the present invention. As illustrated in FIG. 8, the metric, which is represented by reference SNR in FIG. 8, for the frequency bands of higher importance are larger. It should be noted that the above metrics are only for the purpose of illustration, any frequency dependent metric that reflects the importance of the frequency bands may be employed, and the scope of the invention should not be limited in this regard.

Then, at step S703, the first metric and the second metric may first be compared. Then, the lesser one of the two metrics may be determined as an adjusting target, as given by the following Equation (6):

$$f(b)=\min(refSNR(b),SAR(b)) \tag{6}$$

where b represents a frequency band of the audio signal, SAR(b) represents the first metric for a frequency band, b, and refSNR(b) represents the second metric for a frequency band, b.

After the adjusting target is determined, the ratio of the speech component to the non-speech component and the environmental noise signal may be adjusted based on the adjusting target.

In some embodiments of the present invention, at step S703 of the method 700, the adjustment of the ratio of the speech component to the non-speech component and the environmental noise signal may be achieved by boosting the speech component, or, alternatively, by attenuating the non-speech component.

Specifically, in an embodiment of the present invention, once the adjusting target has been determined, a boosting gain g to be applied to the speech component may be derived from the following Equation (7):

$$g(b) = f(refSNR, SAR)\cdot\frac{S_{ns}(b)+N_{ext}(b)}{S_s(b)} \tag{7}$$

Alternatively, in another embodiment of the present invention, an attenuating gain g to be applied to the non-speech component may be derived from the following Equation (8):

$$g(b) = \frac{S_s(b)-N_{ext}(b)\cdot f(refSNR, SAR)}{S_{ns}(b)\cdot f(refSNR, SAR)} \tag{8}$$

where the following condition may be met:

$$S_s(b)-N_{ext}(b):f(refSNR,SAR)\geq 0 \tag{9}$$

Alternatively, in yet another embodiment of the present invention, both the boosting gain for the speech component and the attenuation gain for the non-speech component may be derived.

It should be noted the determination of the first and second metrics, the adjusting target and adjusting gains as discussed above are just for the purpose of illustration, without limiting the scope of the present invention. It would be appreciated that, the first and second metrics may be any form of metrics which indicate the ratio of the speech component to the non-speech component and the ratio of the speech component to the non-speech component and the environmental noise signal, respectively. For example, the metrics may be the logarithm or any other appropriate functions of the ratios. The scope of the present invention should not be limited in this regard.

Alternatively, in order to derive appropriate gains for the speech and/or non-speech component, in an embodiment of the present invention, an iterative search may be performed among the candidate gain(s) such that a certain criterion is met. An example criterion may be that the desirable degree of the intelligibility of the speech content is achieved, while minimum modification gains are applied to the audio signal.

In an embodiment of the present invention, after the gains are derived, it may be further constrained, for example, by employing some compression curves such that, for example, less gain would be applied when the loudness of the external noise is low and vice versa. As such, the derived gains may be further smoothed to avoid sudden change of audio timbre and/or signal power.

Figure 9:
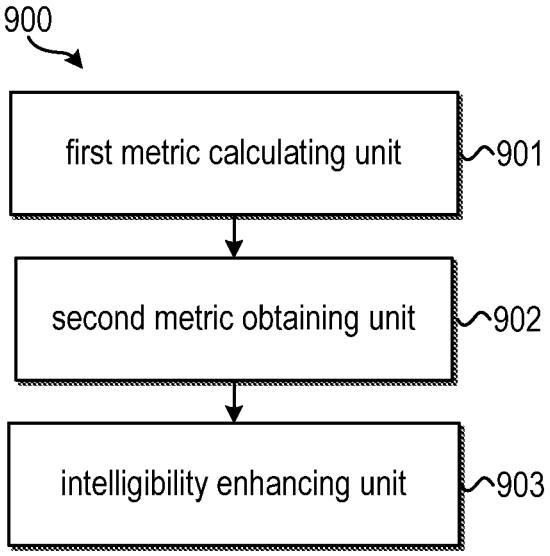
FIG. 9 illustrates a block diagram of a system for enhancing the intelligibility of speech content in an audio signal according to some example embodiments of the present invention.

FIG. 9 illustrates a block diagram of a system 900 for enhancing the intelligibility of speech content in an audio signal according to some example embodiments of the present invention.

As illustrated in FIG. 9, the system 900 comprises a first metric calculating unit 901, a second metric obtaining unit 902 and an intelligibility enhancing unit 903. The first metric calculating unit 901 may be configured to calculate a first metric indicating a ratio of the speech component to the non-speech component. The second metric obtaining unit 902 may be configured to obtain a second metric indicating a reference ratio of the speech component to the non-speech component and an environmental noise signal. The intelligibility enhancing unit 903 may be configured to enhance the intelligibility of the speech component by adjusting a ratio of the speech component to the non-speech component and the environmental noise signal based on the first and second metrics.

In some embodiments of the present invention, the intelligibility enhancing unit 903 may comprise a comparing unit configured to compare the first and second metrics; a ratio adjusting unit configured to adjust the ratio based on the first metric in response to the first metric being less than the second metric and adjust the ratio based on the second metric in response to the first metric being larger than the second metric.

In some embodiments of the present invention, the system 900 may further comprise a reference loudness obtaining unit configured to obtain reference loudness of the audio signal; and a loudness adjusting unit configured to adjust partial loudness of the audio signal to the reference loudness of the audio signal. In the embodiments of the present invention, the first metric calculating unit may be configured to calculate the first metric based on the adjusted audio signal.

In some embodiments of the present invention, the intelligibility enhancing unit 903 may comprise a gain determining unit configured to determine a gain to be applied to the audio signal based on the first and second metrics; a gain constraining unit configured to constrain the determined gain based on the loudness of the environmental noise signal; and a gain applying unit configured to apply the constrained gain to the audio signal.

For the sake of clarity, some optional components of the system 900 are not illustrated in FIG. 9. However, it should be appreciated that the features as described above with reference to FIGS. 7 and 8 are all applicable to the system 900. Moreover, the components of the system 900 may be a hardware module or a software unit module. For example, in some embodiments of the present invention, the system 900 may be implemented partially or completely with software and/or firmware, for example, implemented as a computer program product embodied in a computer readable medium. Alternatively or additionally, the system 900 may be implemented partially or completely based on hardware, for example, as an integrated circuit (IC), an application-specific integrated circuit (ASIC), a system on chip (SOC), a field programmable gate array (FPGA), and so forth. The scope of the present invention is not limited in this regard.

Figure 10:
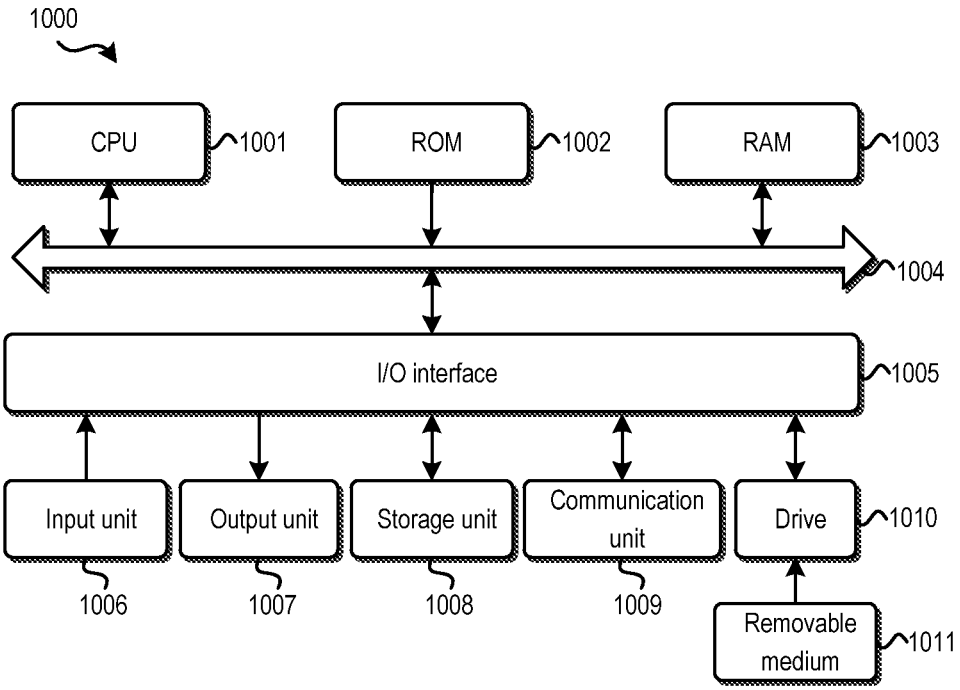
FIG. 10 illustrates a block diagram of an example computer system suitable for implementing embodiments of the present invention Throughout the drawings, the same or corresponding reference symbols refer to the same or corresponding parts.

FIG. 10 illustrates a block diagram of an example computer system 1000 suitable for implementing embodiments of the present invention. As illustrated, the computer system 1000 comprises a central processing unit (CPU) 1001 which is capable of performing various processes according to a program stored in a read only memory (ROM) 1002 or a program loaded from a storage section 1008 to a random access memory (RAM) 1003. In the RAM 1003, data required when the CPU 1001 performs the various processes or the like is also stored as required. The CPU 1001, the ROM 1002 and the RAM 1003 are connected to one another via a bus 1004. An input/output (I/O) interface 1005 is also connected to the bus 1004.

The following components are connected to the I/O interface 1005: an input section 1006 including a keyboard, a mouse, or the like; an output section 1007 including a display such as a cathode ray tube (CRT), a liquid crystal display (LCD), or the like, and a loudspeaker or the like; the storage section 1008 including a hard disk or the like; and a communication section 1009 including a network interface card such as a LAN card, a modem, or the like. The communication section 1009 performs a communication process via the network such as the internet. A drive 1010 is also connected to the I/O interface 1005 as required. A removable medium 1011, such as a magnetic disk, an optical disk, a magneto-optical disk, a semiconductor memory, or the like, is mounted on the drive 1010 as required, so that a computer program read therefrom is installed into the storage section 1008 as required.

Specifically, according to embodiments of the present invention, the processes described above with reference to FIGS. 2-5, 7 and 8 may be implemented as computer software programs. For example, embodiments of the present invention comprise a computer program product including a computer program tangibly embodied on a machine readable medium, the computer program including program code for performing methods 200, 300, 400 and/or 700. In such embodiments, the computer program may be downloaded and mounted from the network via the communication section 1009, and/or installed from the removable medium 1011.

Generally speaking, various example embodiments of the present invention may be implemented in hardware or special purpose circuits, software, logic or any combination thereof. Some aspects may be implemented in hardware, while other aspects may be implemented in firmware or software which may be executed by a controller, microprocessor or other computing device. While various aspects of the example embodiments of the present invention are illustrated and described as block diagrams, flowcharts, or using some other pictorial representation, it will be appreciated that the blocks, apparatus, systems, techniques or methods described herein may be implemented in, as non-limiting examples, hardware, software, firmware, special purpose circuits or logic, general purpose hardware or controller or other computing devices, or some combination thereof.

Additionally, various blocks illustrated in the flowcharts may be viewed as method steps, and/or as operations that result from operation of computer program code, and/or as a plurality of coupled logic circuit elements constructed to carry out the associated function(s). For example, embodiments of the present invention include a computer program product comprising a computer program tangibly embodied on a machine readable medium, the computer program containing program codes configured to carry out the methods as described above.

In the context of the disclosure, a machine readable medium may be any tangible medium that can contain, or store a program for use by or in connection with an instruction execution system, apparatus, or device. The machine readable medium may be a machine readable signal medium or a machine readable storage medium. A machine readable medium may include but is not limited to an electronic, magnetic, optical, electromagnetic, infrared, or semiconductor system, apparatus, or device, or any suitable combination of the foregoing. More specific examples of the machine readable storage medium would include an electrical connection having one or more wires, a portable computer diskette, a hard disk, a random access memory (RAM), a read-only memory (ROM), an erasable programmable read-only memory (EPROM or Flash memory), an optical fiber, a portable compact disc read-only memory (CD-ROM), an optical storage device, a magnetic storage device, or any suitable combination of the foregoing.

Computer program code for carrying out methods of the present invention may be written in any combination of one or more programming languages. These computer program codes may be provided to a processor of a general purpose computer, special purpose computer, or other programmable data processing apparatus, such that the program codes, when executed by the processor of the computer or other programmable data processing apparatus, cause the functions/operations specified in the flowcharts and/or block diagrams to be implemented. The program code may execute entirely on a computer, partly on the computer, as a stand-alone software package, partly on the computer and partly on a remote computer or entirely on the remote computer or server.

Further, while operations are depicted in a particular order, this should not be understood as requiring that such operations be performed in the particular order illustrated or in sequential order, or that all illustrated operations be performed, to achieve desirable results. In certain circumstances, multitasking and parallel processing may be advantageous. Likewise, while several specific implementation details are contained in the above discussions, these should not be construed as limitations on the scope of any invention or of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable sub-combination.

Various modifications, adaptations to the foregoing example embodiments of this invention may become apparent to those skilled in the relevant arts in view of the foregoing description, when read in conjunction with the accompanying drawings. Any and all modifications will still fall within the scope of the non-limiting and example embodiments of this invention. Furthermore, other embodiments of the inventions set forth herein will come to mind to one skilled in the art to which these embodiments of the invention pertain having the benefit of the teachings presented in the foregoing descriptions and the drawings.

It will be appreciated that the embodiments of the invention are not to be limited to the specific embodiments disclosed and that modifications and other embodiments are intended to be included within the scope of the appended claims. Although specific terms are used herein, they are used in a generic and descriptive sense only and not for purposes of limitation.

What is claimed is:

1. A method for enhancing intelligibility of speech content in an audio signal, the speech content contained in a speech component of the audio signal, the method comprising:

obtaining reference loudness of the audio signal;

enhancing the intelligibility of the speech content by adjusting partial loudness of the audio signal based on the reference loudness and a degree of the intelligibility; and outputting, from a loudspeaker, the audio signal having the intelligibility of the speech content enhanced, wherein enhancing the intelligibility of the speech content by adjusting the partial loudness of the audio signal comprises:

adjusting the partial loudness of the audio signal to the reference loudness;

determining whether an intelligibility criterion is met by the intelligibility of the speech content in the adjusted audio signal;

determining target loudness in response to the intelligibility criterion being not met; and adjusting the partial loudness of the audio signal to the target loudness, wherein determining the target loudness comprises:

calculating a first metric indicating a ratio of the speech component to the non-speech component;

calculating a second metric indicating a ratio of the speech component to the non-speech component and an environmental noise signal;

determining additional loudness based on the first and second metrics; and determining the target loudness based on the reference loudness and the additional loudness.

2. The method according to claim 1, wherein adjusting the partial loudness of the audio signal comprises:

increasing the partial loudness of the speech component based on the reference loudness and the degree of the intelligibility.

3. The method according to claim 1, wherein adjusting the partial loudness of the audio signal comprises:

in response to a determination that the audio signal contains a non-speech component, reducing the partial loudness of the non-speech component based on the reference loudness and the degree of the intelligibility.

4. The method according to claim 1, wherein the first and second metrics are calculated at least partially based on a frequency band of the audio signal.

5. The method according to claim 1, wherein the ratio of the speech component to the non-speech component and the environmental noise signal is adjusted during a speech section, the speech section containing at least a part of the speech component.

6. The method according to claim 5, wherein the first metric is calculated for a frequency band of the audio signal, and wherein the second metric is obtained at least partially based on the frequency band.

7. The method according to claim 1, wherein adjusting the partial loudness of the audio signal comprises:

determining a gain to be applied to the audio signal based on the first and second metrics;

constraining the determined gain based on the loudness of the environmental noise signal; and applying the constrained gain to the audio signal.

8. The method according to claim 1, wherein adjusting the partial loudness is performed iteratively by adjusting the target loudness by an increment and adjusting the partial loudness based on the target loudness having been iteratively adjusted.

9. The method according to claim 1, wherein adjusting the partial loudness is performed using a mapping function derived from empirical psychoacoustic studies.

10. The method according to claim 1, wherein the first metric is calculated according to an equation:

$$SAR_{SI} = \sum_{b} W(b) \cdot \max\left(\min\left(20\log_{10}\frac{S_s(b)}{S_{ns}(b)}, T_{max}\right), T_{min}\right)$$

wherein $SAR_{SI}$ represents the first metric, b represents a frequency band of the audio signal, W(b) represents a weight value for the frequency band b, $S_s$ (b) represents the speech component of the audio signal for the frequency band b, $S_{ns}$(b) represents the non-speech component of the audio signal for the frequency band b, $T_{max}$ represents a maximum threshold, and $T_{min}$ represents a minimum threshold.

11. The method according to claim 1, wherein the second metric is calculated according to an equation:

$$SNAR_{SI} = \sum_{b} W(b) \cdot \max\left(\min\left(20\log_{10}\frac{S_{LR-s}(b)}{S_{LR-ns}(b) + N_{est}(b)}, T_{max}\right), T_{min}\right)$$

wherein $SNAR_{SI}$ represents the second metric, b represents a frequency band of the audio signal, W(b) represents a weight value for the frequency band b, $S_{LR-s}$(b) represents the partial loudness of the speech component for the frequency band b, $S_{LR-ns}$(b) represents the partial loudness of the non-speech component for the frequency band b, $N_{est}$(b) represents the environmental noise signal for the frequency band b, $T_{max}$ represents a maximum threshold, and $T_{min}$ represents a minimum threshold.

12. The method according to claim 1, wherein the first metric and the second metric are constrained within a human perceptual range.

13. A system for enhancing intelligibility of speech content in an audio signal, the speech content contained in a speech component of the audio signal, the system comprising:

a reference loudness obtaining unit configured to obtain reference loudness of the audio signal;

an intelligibility enhancing unit configured to enhance the intelligibility of the speech content by adjusting partial loudness of the audio signal based on the reference loudness and a degree of the intelligibility; and a loudspeaker configured to output the audio signal having the intelligibility of the speech content enhanced, wherein the intelligibility enhancing unit comprises:

a loudness adjusting unit configured to adjust the partial loudness of the audio signal to the reference loudness and adjust the partial loudness of the audio signal to a target loudness in response to an intelligibility criterion being not met;

an intelligibility determining unit configured to determine whether the intelligibility criterion is met by the intelligibility of the speech content in the adjusted audio signal; and a target loudness determining unit configured to determine the target loudness in response to the intelligibility criterion being not met, wherein the target loudness determining unit comprises:

a first metric calculating unit configured to calculate a first metric indicating a ratio of the speech component to the non-speech component;

a second metric calculating unit configured to calculate a second metric indicating a ratio of the speech component to the non-speech component and an environmental noise signal;

an additional loudness determining unit configured to determine additional loudness based on the first and second metrics; and a determining unit configured to determine the target loudness based on the reference loudness and the additional loudness.

14. The system according to claim 13, wherein the intelligibility enhancing unit comprises a loudness adjusting unit configured to increase the partial loudness of the speech component based on the reference loudness and the degree of the intelligibility.

15. The system according to claim 13, wherein the intelligibility enhancing unit comprises a loudness adjusting unit configured to reduce the partial loudness of the non-speech component based on the reference loudness and the degree of the intelligibility in response to a determination that the audio signal contains a non-speech component.

16. The system according to claim 13, wherein the first metric calculating unit is further configured to calculate the first metric at least partially based on a frequency band of the audio signal, and wherein the second metric calculating unit is further configured to calculate the second metric at least partially based on the frequency band.

17. The system according to claim 13, wherein the second metric calculating unit is further configured to adjust the ratio of the speech component to the non-speech component and the environmental noise signal during a speech section, the speech section containing at least a part of the speech component.

18. The system according to claim 13, wherein the first metric calculating unit is further configured to calculate the first metric for a frequency band of the audio signal, and wherein the second metric obtaining unit is further configured to obtain the second metric at least partially based on the frequency band.

19. The system according to claim 13, wherein the intelligibility enhancing unit comprises:

a gain determining unit configured to determine a gain to be applied to the audio signal based on the first and second metrics;

a gain constraining unit configured to constrain the determined gain based on the loudness of the environmental noise signal; and a gain applying unit configured to apply the constrained gain to the audio signal.

20. The system according to claim 13, wherein adjusting the partial loudness is performed iteratively by adjusting the target loudness by an increment and adjusting the partial loudness based on the target loudness having been iteratively adjusted.

21. The system according to claim 13, wherein adjusting the partial loudness is performed using a mapping function derived from empirical psychoacoustic studies.

22. The system according to claim 13, wherein the first metric is calculated according to an equation:

$$SAR_{SI} = \sum_{b} W(b) \cdot \max\left(\min\left(20\log_{10}\frac{S_s(b)}{S_{ns}(b)}, T_{max}\right), T_{min}\right)$$

wherein $SAR_{SI}$ represents the first metric, b represents a frequency band of the audio signal, W(b) represents a weight value for the frequency band b, $S_s$ (b) represents the speech component of the audio signal for the frequency band b, $S_{ns}$(b) represents the non-speech component of the audio signal for the frequency band b, $T_{max}$ represents a maximum threshold, and $T_{min}$ represents a minimum threshold.

23. The system according to claim 13, wherein the second metric is calculated according to an equation:

$$SNAR_{SI} = \sum_{b} W(b) \cdot \max\left(\min\left(20\log_{10}\frac{S_{LR-s}(b)}{S_{LR-ns}(b) + N_{est}(b)}, T_{max}\right), T_{min}\right)$$

wherein $SNAR_{SI}$ represents the second metric, b represents a frequency band of the audio signal, W(b) represents a weight value for the frequency band b, $S_{LR-s}$(b) represents the partial loudness of the speech component for the frequency band b, $S_{LR-ns}$(b) represents the partial loudness of the non-speech component for the frequency band b, $N_{est}$(b) represents the environmental noise signal for the frequency band b, $T_{max}$ represents a maximum threshold, and $T_{min}$ represents a minimum threshold.

24. The system according to claim 13, wherein the first metric and the second metric are constrained within a human perceptual range.

25. A computer program product for enhancing intelligibility of speech content in an audio signal, the computer program product being tangibly stored on a non-transitory computer-readable medium and comprising machine executable instructions which, when executed, cause the machine to perform steps of the method according to claim 1.

* * * * *